US005382079A

United States Patent [19]

Wilson et al.

[11] Patent Number: 5,382,079

[45] Date of Patent: Jan. 17, 1995

[54] ADJUSTABLE ARM ATTACHABLE TO A CHAIR BODY

[75] Inventors: Robert L. Wilson, Memphis, Tenn.; Ernest Pittman, Courtland; Lester E. Holmes, Southhaven, both of Miss.

[73] Assignee: Chromcraft Revington, Inc., Senatobia, Miss.

[21] Appl. No.: 142,704

[22] Filed: Oct. 25, 1993

[51] Int. Cl.[6] ..... A47C 7/54

[52] U.S. Cl. ..... 297/411.36; 297/411.35; 297/411.37

[58] Field of Search ..... 297/115, 411.2, 411.21, 297/411.23, 411.24, 411.26, 411.27, 411.28, 411.35, 411.36, 411.37, 353, 410; 248/118, 118.3

[56] References Cited

U.S. PATENT DOCUMENTS

| | | | |
|---|---|---|---|
| 413,156 | 10/1889 | Wilkerson . | |
| 2,030,635 | 2/1936 | Horwitt et al. | 297/416 X |
| 3,124,328 | 3/1964 | Kortsch . | |
| 3,950,027 | 4/1976 | Wilson | 297/411.35 X |
| 4,159,148 | 6/1979 | Schulz . | |
| 4,244,623 | 1/1981 | Hall et al. | 297/411.36 |
| 4,660,885 | 4/1987 | Suhr et al. | 297/353 |
| 4,763,952 | 8/1988 | Gaudreau, Jr. | 297/383 |
| 4,764,790 | 6/1987 | Johnson | 296/153 |
| 4,786,108 | 11/1988 | Dauphin | 297/353 |
| 4,881,424 | 11/1989 | Clark et al. | 74/523 |
| 4,884,846 | 12/1989 | Tobler . | |
| 4,951,995 | 8/1990 | Teppo et al. . | |
| 5,009,467 | 4/1991 | McCoy . | |
| 5,143,422 | 9/1992 | Althoger et al. . | |
| 5,265,938 | 11/1993 | Melhuish et al. | 297/411.36 |

*Primary Examiner*—Kenneth J. Dorner
*Assistant Examiner*—Milton Nelson, Jr.
*Attorney, Agent, or Firm*—Wolf, Greenfield & Sacks

[57] ABSTRACT

An adjustable chair arm attachable to a chair body. The arm is capable of being moved horizontally, toward and away from the chair seat, and vertically with respect to the seat. The adjustable arm includes an arm frame assembly having a generally vertical section. The adjustable arm also includes an arm body having an upper housing and a sleeve portion which is slidably mounted on the generally vertical section of the arm frame assembly for vertical adjustment of the chair arm. A latching assembly is connected to the frame assembly and arm body for releasably locking the arm body in a plurality of vertical positions on the frame assembly. Lastly, an actuator, integral with the latching assembly, is provided for disabling the latching assembly.

6 Claims, 5 Drawing Sheets

ADJUSTABLE ARM ATTACHABLE TO A CHAIR BODY

BACKGROUND OF THE INVENTION

1. Field of the Invention

The present invention relates to chairs with adjustable arms and, more particularly, to a chair arm which is vertically adjustable with respect to a chair seat.

2. Description of the Prior Art

Increasingly, chairs designed for use in the office environment for both management and support staff are ergonomically designed for comfort. These chairs generally include body contoured cushions, seat height adjustments, seat swivels and reclining backs. Recently, designs of office furniture, such as chairs, have attempted to address user's comfort and healthful body support when seated for long periods of time while, for example, working at a computer terminal. The comfortable positioning of a user's arms has become a significant factor in the overall ergonometric design to address problems such as Carpel Tunnel Syndrome. These chairs have incorporated arms which can be adjusted upwardly and downwardly relative to the seat cushion to support a variety of user's arm positions during a variety of tasks. These chairs, such as EVERY-DAY® chairs (registered trademark of HON Industries, Muscatine, Iowa) and the PERFORMA 2 TM series high performance ergonomic seating (trademark of Superior Chaircraft), provide attachable arms which are adjustable only upwardly and downwardly relative to the seat.

None of the foregoing, or other prior art chairs for use in the office, incorporate adjustable arms which can be adjusted vertically as well as horizontally, to provide an enhanced ergonometric design for user safety and comfort.

It is, therefore, an object of the invention to provide an adjustable arm for an office chair which can be adjusted horizontally and vertically.

It is a further object of the invention to provide an adjustable arm for use with a chair in the office environment which can be adjusted both vertically and horizontally and can be removably attached to the body of the chair.

SUMMARY OF THE INVENTION

Accordingly, the present invention provides an adjustable arm attachable to a chair body. The adjustable arm is capable of being moved horizontally, toward and away from the sides of the chair seat, and vertically with respect to the seat.

The adjustable chair arm includes an arm frame assembly having a generally vertical section. The adjustable arm also includes an arm body having an upper housing and a secure portion mounted on the generally vertical section of the arm frame assembly for vertical adjustment of the chair arm. A latching assembly is connected to the frame assembly and arm body for releasably locking the arm in a plurality of vertical positions on the frame assembly. An actuator is integral with the latching assembly for disabling the latching assembly. An adjusting means is connected to the frame assembly for mounting the arm to a chair body and allowing the arm to be horizontally adjusted with respect thereto.

In one specific embodiment, the adjustable arm includes an arm frame assembly having a bracket at its lower end and a tubular portion extending upwardly from the bracket. An adjustment bracket is mounted in the upper end of the tubular portion of the frame assembly. The adjustment bracket includes a series of vertically arranged notches within the tubular portion. The adjustable arm also includes an arm body having an upper housing and a sleeve portion slidably mounted on the tubular portion of the arm frame assembly. An attachment plate is fixed to the arm body upper housing and includes a pivot support within the upper housing. An adjustment lever is pivotally mounted on the pivot support including a control arm extending into the tubular portion of the frame assembly for engaging the notches on the adjustment bracket, permitting vertical adjustment of the arm body on the tubular portion. Lastly, an actuating button is integral with the adjustment lever and extends out of the upper housing for pivoting the control arm into and out of engagement with the notches on the adjustment bracket. A spring engages the lever to bias it to the operative position.

Other objects and features of the present invention will become apparent from the following detailed description when read in connection with the accompanying drawings. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which:

FIG. 1 is a perspective view of a chair having an adjustable arm of the present invention;

DETAILED DESCRIPTION OF THE INVENTION

The chair arm attachable to a chair body of the present invention can be vertically and horizontally adjusted. The adjustable arm includes an arm frame assembly having means for mounting the arm to the chair body, while allowing the arm to be horizontally adjusted with respect to the chair seat. The arm also includes means for vertically adjusting the arm in a plurality of positions on the frame assembly.

Figure 2:
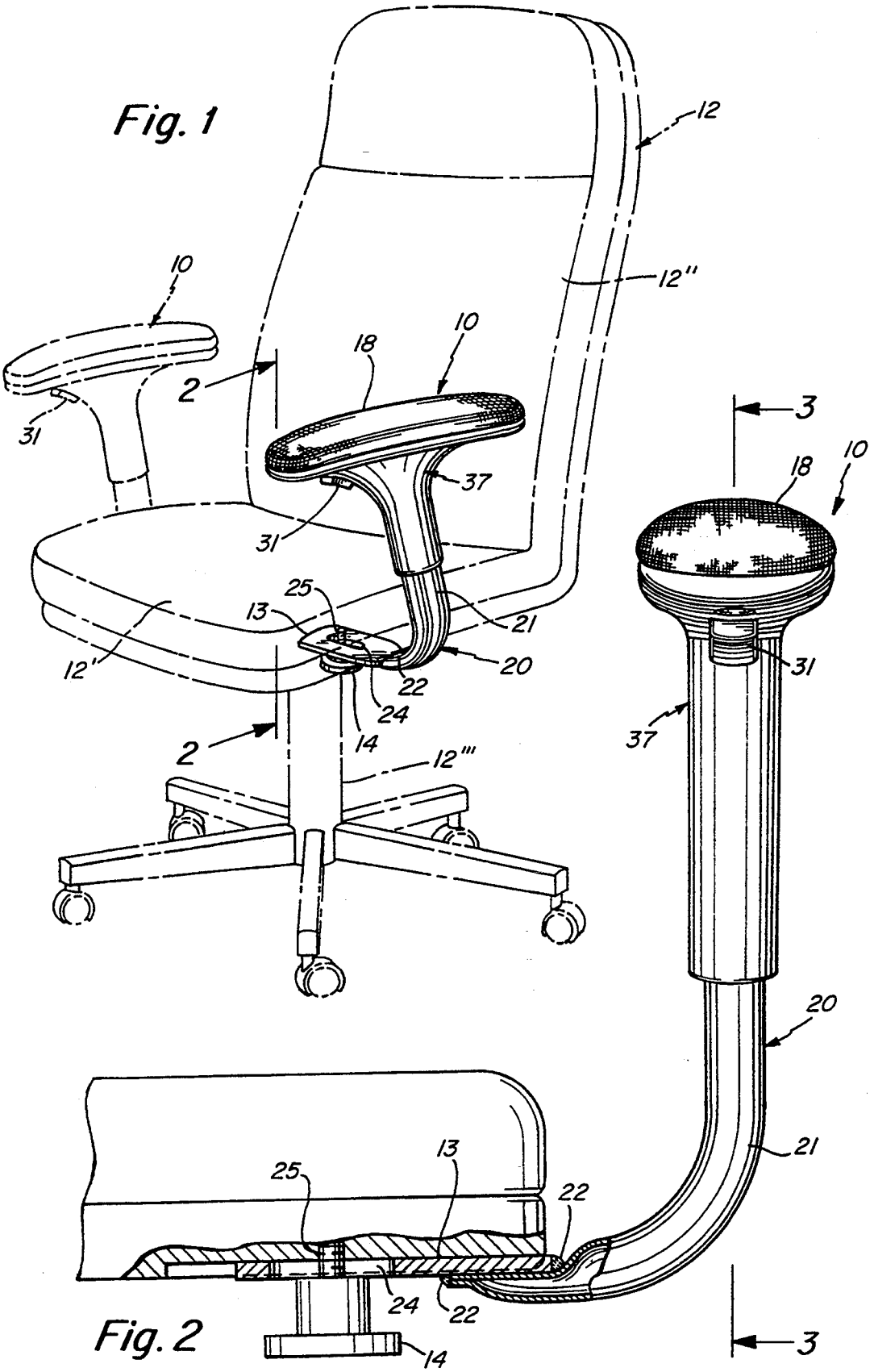
FIG. 2 is a partially broken away front view of the adjustable arm attached to the seat of the chair as seen along line 2—2 of FIG. 1.
Figure 3:
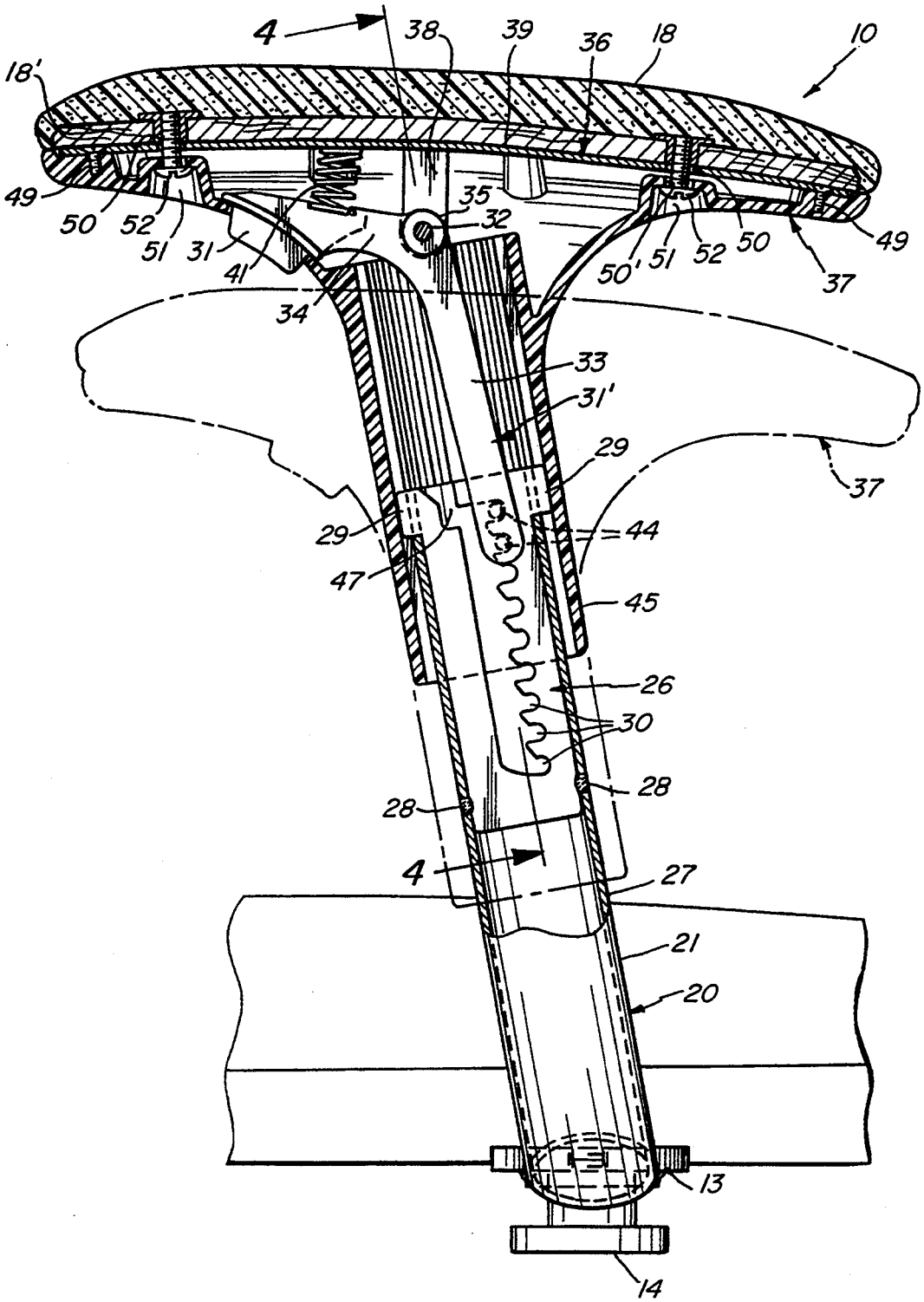
FIG. 3 is an enlarged cross-section of the adjustable arm taken along section line 3—3 of FIG. 2.
Figure 4:
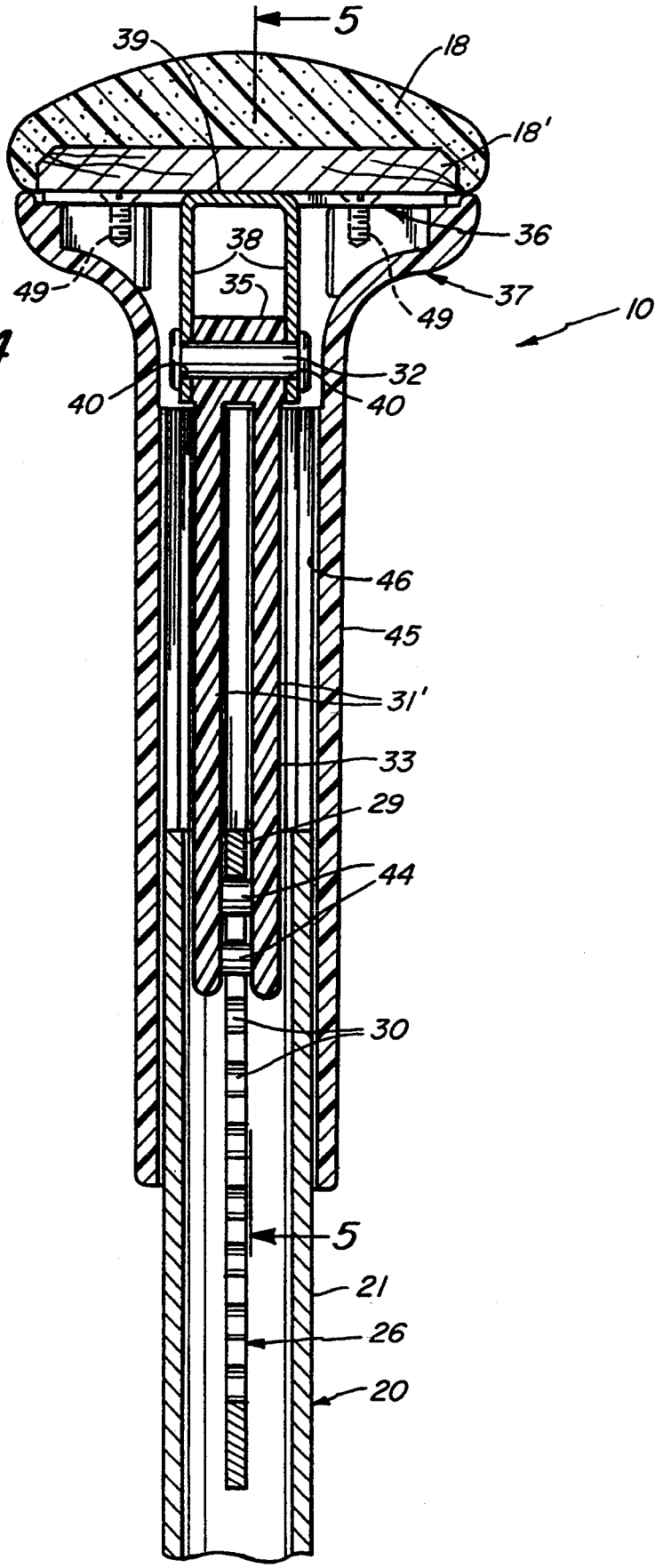
FIG. 4 is an enlarged cross-section of the adjustable arm taken along section line 4—4 of FIG. 3.
Figure 7:
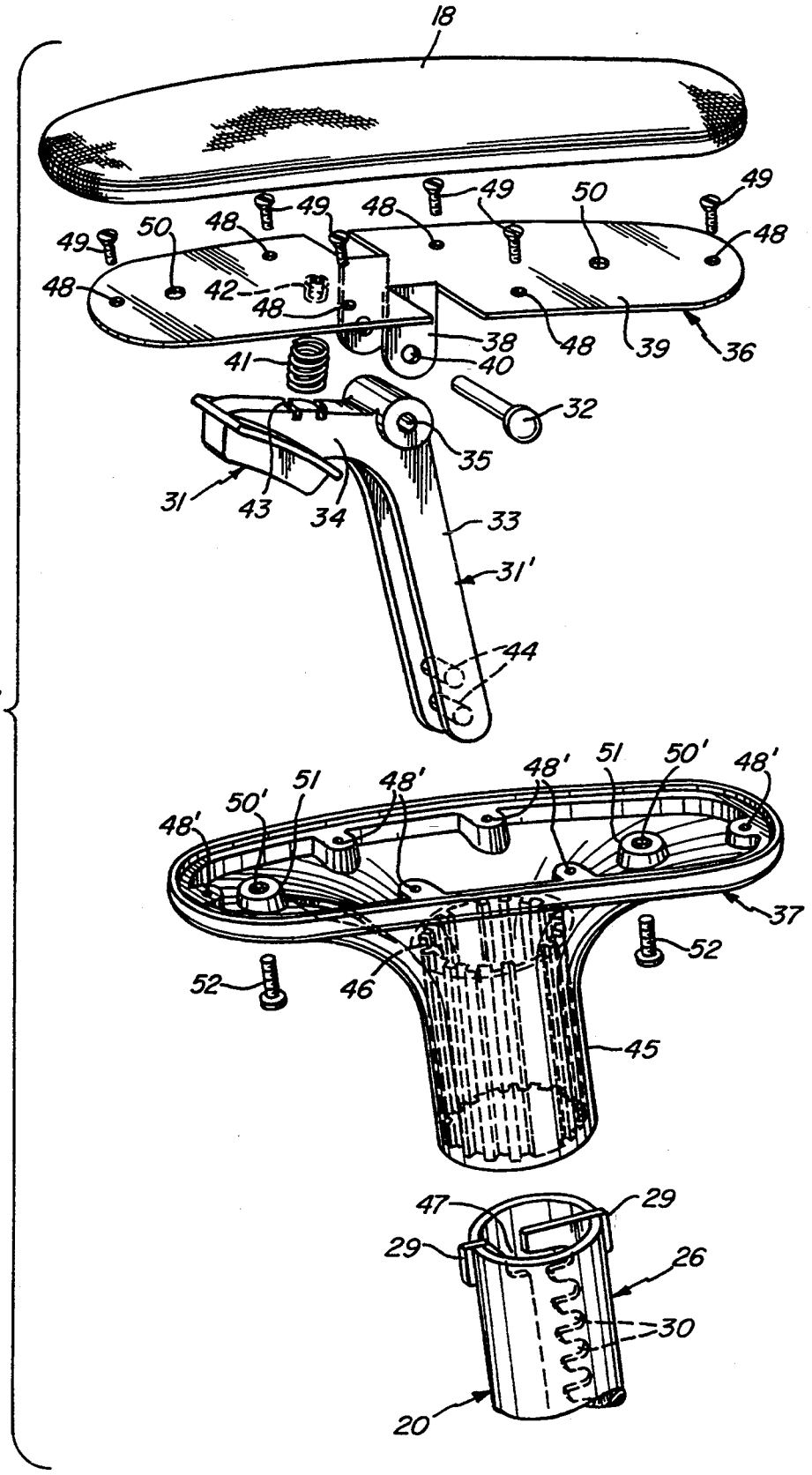
FIG. 7 is an exploded view of the adjustable arm of the present invention.

Turning now to the drawings, wherein like reference numerals indicate like elements, FIGS. 1–7 illustrate one embodiment of an adjustable arm 10 attached to a chair 12 in accordance with the present invention. Adjustable arm 10 of the present invention is comprised of six primary parts, as shown in FIGS. 3 and 7, including arm frame assembly 20, arm adjustment bracket 26, adjustable arm body 37, attachment plate 36, arm adjustment lever and integral actuating button 31.

Referring now to FIG. 1, two adjustable chair arms 10 are shown attached to chair 12 having a seat portion 12', a back portion 12'' and a base portion 12'''. Chair 12, and its elements, can be selected from chairs designed for use in the office environment for management and support staff, and are generally known to those skilled in the art. For simplicity only one adjustable chair arm assembly 10 will be described.

As shown in FIGS. 1 and 2, horizontal brackets 13 enable arms 10 to be moved toward and away from one another. A knob 14 located at the bottom of arm 10, beneath seat 12', allows arm 10 to be moved outwardly or inwardly with respect to seat 12', when loosened. An actuating button 31 is positioned on the front of each arm 10, immediately beneath arm cushion 18. When button 31 is depressed, arm 10 can be raised or lowered at the will of the user.

The adjustable arm includes an arm frame assembly 20 having an oval tube 21 which is flattened front to back and bent at substantially a right angle. Horizontal bracket 13 is located on the lower section of arm frame assembly 20. Preferably bracket 13 is welded at 22 to frame assembly. The bracket has a slot 24 through which a clamp, preferably threaded screw 25, carried by knob 14 on the bottom of chair 12, extends so that bracket 13 can be tightened or loosened against the bottom of chair 12 to hold it either firmly in place, or permit it to be moved horizontally for adjustment.

Figure 5:
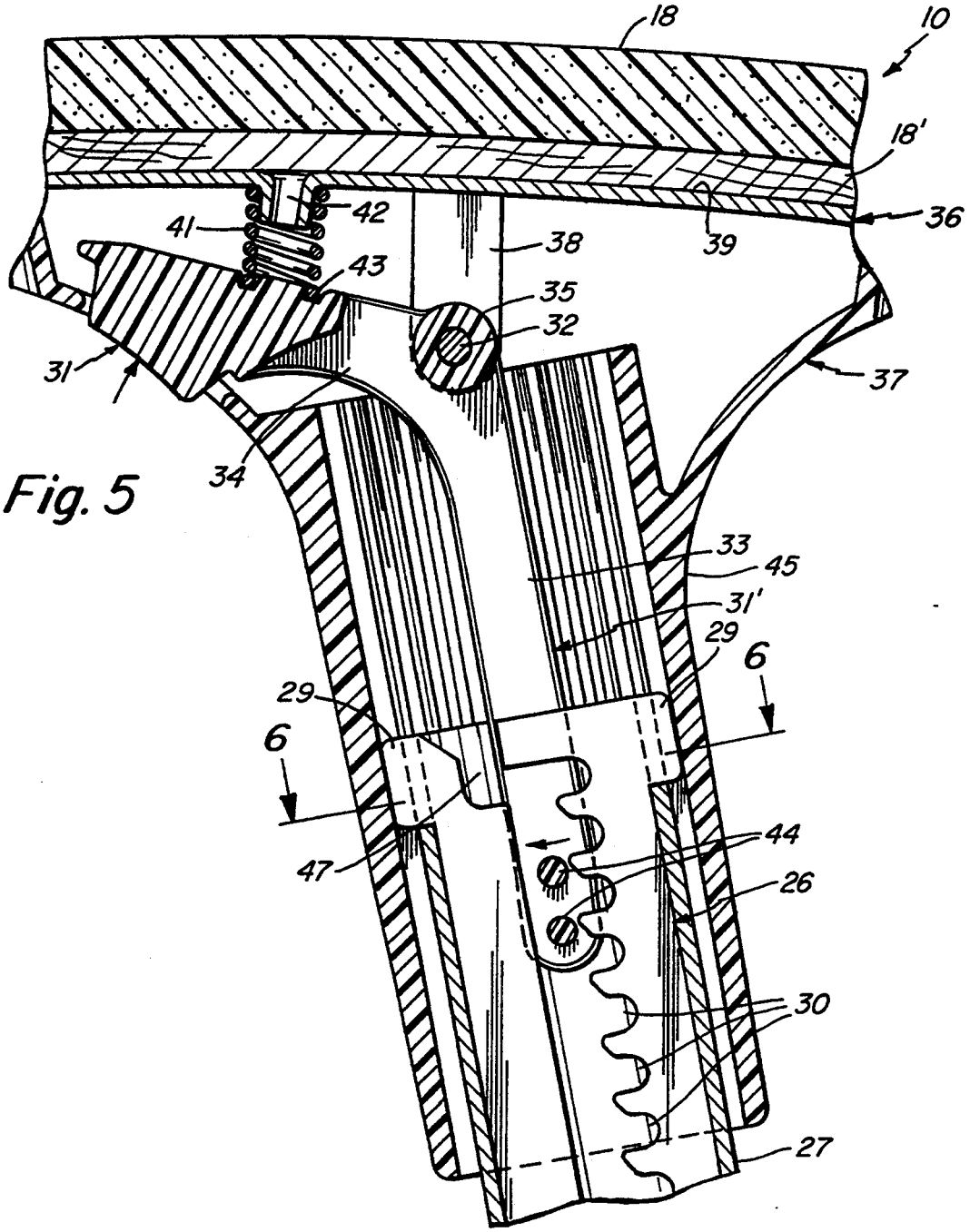
FIG. 5 is an enlarged cross-section of the adjustable arm taken along section line 5—5 of FIG. 4 and with the actuating button depressed so that the arm can be raised and lowered as desired.
Figure 6:
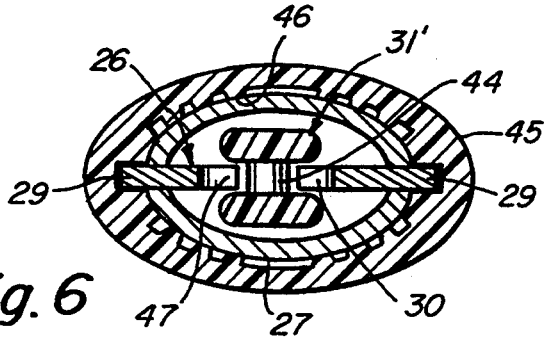
FIG. 6 is an enlarged cross-section of the adjustable arm taken along section line 6—6 of FIG. 5.

As shown in FIGS. 3–7, the arm adjustment bracket 26 is welded at 28 onto vertical portion 27 of tube 21 of arm frame assembly 20. Arm adjustment bracket 26 includes flanges 29, as best shown in FIGS. 5 and 7, which sit in slots cut into the top of vertical portion 27 of tube 21, and are preferably welded in a fixed position. Arm adjustment bracket 26 has a series of vertically arranged notches 30 spaced along the length of the bracket, which provide different height settings for the adjustable arm 10 as explained in detail below.

The actuating button 31 is integral with arm adjustment lever 31'. The lever 31' is pivotally mounted with pivot pin 32 to the attachment plate 36. Lever 31' holds arm body 37 in a selected position by engaging notches 30 on adjustment bracket 26. As shown in FIG. 3, lever 31' allows for vertical adjustment of arm 10 by enabling the arm body 37 to telescopically move up and down on vertical portion 27 of tube 21. Adjustment lever 31' is in the form of a crank, having a long arm portion 33 and a short arm portion 34. The short arm includes actuating button 31 that extends out the front of the arm body 37, beneath cushion 18, as described above. The adjustment lever 31' also includes a hub 35 at its bend (see FIG. 7) that defines the pivotal axis.

Attachment plate 36 is fixed to arm body 37, and has a pair of ears 38, or pivot supports, that extend downwardly from the plate's main surface 39. The ears are provided with holes 40 to receive pivot pin 32 and supports lever 31' beneath the plate. A biasing means 41, typically a coil spring is mounted between attachment plate 36 and adjustment lever 31' to bias the lever to the extended position, that is, the position in which button 31 extends out of arm body 37, beneath cushion 18. As shown in FIG. 5, the spring is held in place by boss 42 that is positioned on the bottom of attachment plate 36, just forward of pivot supports 38. The lower end of spring 41 is seated in an annular recess 43 on the top portion of the adjustment lever's short arm 34. In operation, when button 31 is depressed, spring 41 is compressed, and the spring returns the button to the extended position when it is released.

The lower end portion of the adjustment lever's long arm 33 supports a pair of pins 44 that extend between the long arm's two sides, as shown in FIG, 4. Pins 44 are designed to register with notches 30 in arm adjustment bracket 26 to hold arm 10 at the desired elevation.

As shown in FIG. 7, adjustable arm body 37, has an elliptical, downwardly extending tube portion 45 that is sized to fit over generally vertical portion 27 of tube 21 in the arm frame assembly. The tube portion 45 has a ribbed inner surface 46, shown in FIG. 6, to reduce the surface-to-surface contact of tube portion 45 and arm frame assembly 20. The reduced surface-to-surface contact lessens the friction between the two parts to enable arm body 37 to move smoothly up and down on tube 21 of the arm frame assembly.

In assembling the parts, as illustrated in FIG. 7, adjustable arm body 37 is slipped over adjustment bracket 26, welded to arm frame assembly 20 (shown in FIG. 3) to the lowest position on the assembly. Next, the sub-assembly, including arm adjustment lever 31' and attachment plate 36, is positioned with long arm 33 of the adjustment lever extending into vertical tube 21 of the arm frame assembly. The sub-assembly's adjustment lever 31' and attachment plate 36 are tilted to enable pins 44 on the lower end of the long arm of the adjustment lever, to enter slot 47 in arm adjustment bracket 26. When long arm 33 of adjustment lever 31 is in position, and pins 44 are engaging notches 30 in the adjustment bracket, adjustable arm body 37 is elevated. Six screw holes 48, 48' are provided in adjustable arm body 37 and attachment plate 36, enabling the two parts to be secured with screws 49. There are also screw holes 50 located on each side of plate 36, with corresponding holes 50' provided in recesses 51 in the arm body. Screws 52 are used in holes 50, 50' to secure cushion assembly 18.

The adjustable arm body 37 assembly is completed by securing cushion assembly 18. Typically, cushion 18 can be made from any natural or synthetic foamed material, to provide users with soft, resilient, and comfortable arm rests. Preferably, cushions 18 are made of urethane foam due to its relative inexpensive cost, comfort and durability. In addition, cushion 18 is typically covered with a fabric material to enhance the chair's aesthetic effect. Cushion 18 is typically first secured to a support panel 18' with an adhesive or the like. Preferably, panel 18' is made of an inexpensive lightweight material such as wood or plastic, which can be rigidly secured to the top portion of the adjustable arm body and attachment plate. The cushion assembly is mounted in place by screws 52 that extend upwardly into the arm body with the screw heads disposed in recesses 51 in the lower, hidden surface of the arm, out of view.

In operation, when actuating button 31 is depressed, arm adjustment lever 31' pivots, and actuating pins 44 at the lower end of long arm 33 move out of notches 30 in arm adjustment bracket 26. When pins 44 are positioned out of registration with notches 30 as in FIG. 5, the arm body and the parts carried by it may be raised or lowered on the arm frame assembly 20. When button 31 is released, pins 44 register with notches 30 in the adjustment bracket and support the assembly at the desired arm height.

The present invention will be further illustrated by the following example, which is intended to be illustrative in nature and is not to be construed as limiting the scope of the invention.

EXAMPLE

One suitable construction of an adjustable arm attachable to a chair body substantially in accordance with the present invention is provided by the following combination of elements.

An adjustable arm attachable to a chair body is provided that is capable of being moved horizontally toward and away from the chair body and vertically with respect to the chair.

The adjustable arm includes an arm frame assembly having a substantially horizontal bracket at its lower end and a substantially vertical tubular portion extending upwardly from the bracket. The adjustable arm frame assembly is made from an oval steel tube which is bent at an angle of approximately 90°. The substantially horizontal bracket at its lower end is fillet welded to the lower portion of the bent oval tube. Including the substantially horizontal bracket portion, the adjustable arm frame assembly has a height of approximately 7.75 inches and a horizontal length of approximately 7.9 inches. The substantially horizontal bracket portion has a length of approximately 4.5 inches and a width of approximately 2.25 inches. The bracket portion includes a centered oval slot having a length of about 1.9 inches and a width of about 0.4 inch. A screw attached to a knob is provided for connecting the arm to the chair body at the bottom of the chair. The screw and slot assembly allows the arm to be horizontally adjusted by tightening or loosening the bracket against the bottom of the chair to hold it either firmly in place, or permit it to be moved within a range of about 1.5 inches along the oval slot length for adjustment.

An adjustment bracket is welded in the upper end of the substantially vertical tubular portion of the adjustable arm frame assembly. The adjustment bracket is made of an 11 gauge steel strip having a length of about 4.0 inches and a width of about 1.3 inches. The bracket includes a series of vertically arranged notches which, when the adjustment bracket is welded in place, sit within the substantially vertical tubular portion. There are eight notches which are centered approximately 0.4 inch apart, allowing for a vertical adjustment range of about 3.0 inches. The arm adjustment bracket also includes a slot, for providing access to the notches, that is approximately 0.6 inch wide and is positioned approximately 0.4 inch from the edge of the bracket. Lastly, the bracket includes two flanges positioned at the top portion of the adjustment bracket. The flanges are about 0.5 inch long and about 0.25 inch wide, and provide a surface to weld the bracket to the arm frame assembly.

An adjustable arm body is provided having an upper housing and a sleeve portion slidably mounted on the substantially vertical tubular portion of the arm frame assembly. The adjustable arm body is made of a glass-filled nylon material and has a height of approximately 6.8 inches, a length of approximately 9.75 inches, and a width of approximately 2.8 inches at its largest points. The adjustable arm body also includes an elliptical, downwardly extending tubular portion that is sized to fit over the substantially vertical tubular portion of the arm frame assembly. The elliptical portion of the adjustable arm body has an outer length of approximately 2.2 inches and an outer width of about 1.3 inches. The elliptical tubular portion has a ribbed inner surface to reduce the surface-to-surface contact of the adjustable arm body and the adjustable arm frame assembly, allowing for smooth vertical movement on the substantially vertical tube of the arm frame.

An attachment plate is fixed to the adjustable arm body's upper housing. The attachment plate includes a pivot support which is positioned within the arm body's upper housing. The attachment plate is made of 14 gauge steel, and is approximately 9.3 inches in length and approximately 2.4 inches wide at its largest points. The plate includes a punched circular boss, extending into the arm body's upper housing, having a diameter of about 0.3 inch. The attachment plate is fixed to the arm body's upper housing by attachment screws which are fitted through six punched 0.2 inch diameter holes in the plate surface. The holes are mated with similar sized holes in the upper housing of the arm body. A centered projection, or pivot support is comprised of two tabs, or projections, of about 1.0 inch length, and 0.5 inch width which are spaced about 0.6 inch apart. Each tab includes a 0.25 inch hole at its lower portion for securing a pivot pin.

An arm adjustment lever is pivotally mounted on the pivot support. The arm adjustment lever is made of glass-filled nylon and includes a control arm extending into the tubular portion of the arm frame assembly for engaging the notches on the adjustment bracket, thereby permitting vertical adjustment of the arm body on the tubular portion of the arm frame assembly. The arm adjustment lever is in the form of a crank having a long arm approximately 4.0 inches from the pivot, and a short arm approximately 2.4 inches from the pivot. The short arm carries an actuating button which is rectangular in shape, approximately 1.3 inches in length and 1.0 inches in width. The actuating button extends out of the adjustable arm body. The lower end portion of the adjustment lever's long arm includes two pins that extend between the long arm's two sides, approximately 0.4 inches apart. The first pin is approximately 3.3 inches from the pivot. The pins are designed to register with the notches in the arm adjustment bracket to hold the arm at the desired elevation. The two arms of the adjustment lever are approximately 113° apart.

Lastly, the arm body assembly is completed by securing a cushion made of a polyurethane material, and covered with a polyester fabric material, to the top portion of the adjustable arm body and attachment plate. The urethane material is oval in shape and has a length of approximately 9.8 inches and a width of approximately 2.9 inches at its widest points, and a thickness of about 0.8 inches at its thickest point. The urethane cushion is attached to a 14 gauge steel panel that is shaped similarly to the urethane cushion, and has a thickness of approximately 0.071 inch. The cushion is molded in place on the steel panel. Two extruded and tapped holes, approximately 6.1 inches apart, 1.5 inches from the side portion of the steel panel, 2.0 inches from one edge and 1.7 inches from the opposite edge, are used to secure the urethane assembly to the arm body and attachment plate. Recessed holes are similarly spaced in the arm body, and punched holes are included in the attachment plate at similar locations for receiving two screws for securing the urethane cushion assembly.

Although particular embodiments of the invention have been described in detail for purposes of illustration, various modifications may be made without departing from the spirit and scope of the invention. For example, other materials of construction for each assembly component can be used, provided they support and function as required. Furthermore, one skilled in the art could interchange and adapt other materials into the arm assembly of the present invention. Moreover, it is noted that alternative horizontal and vertical adjustment limits of the adjustable arm can be made as required and/or desired by users. Accordingly, the invention is not to be limited except as by the appended claims.

What is claimed is:

1. An adjustable arm attachable to a chair body and capable of being moved horizontally toward and away from the chair body and vertically with respect to the chair body, comprising:

an arm frame assembly having a bracket at its lower end and a tubular portion extending upwardly from the bracket;

an adjustment bracket mounted in the upper end of the tubular portion of the frame assembly, said adjustment bracket having a series of vertically arranged notches within the tubular portion;

an arm body having an upper housing, and a sleeve portion slidably mounted on the tubular portion of the frame assembly;

an attachment plate fixed to the arm body upper housing having a pivot support within the upper housing;

an adjustment lever pivotally mounted on the pivot support having a control arm extending into the tubular portion of the frame assembly for engaging the notches on the adjustment bracket, permitting vertical adjustment of the arm body on the tubular portion; and an actuating button integral with the adjustment lever and extending out of the upper housing for pivoting the control arm into and out of engagement with the notches on the adjustment bracket, said adjustment lever is engaged with a spring for biasing the lever.

2. The adjustable arm of claim 1 wherein the arm frame assembly bracket has a screw and slot assembly for connecting the arm to the chair body and enabling the arm to be horizontally adjusted with respect thereto.

3. The adjustable arm of claim 1 wherein the adjustment lever is a crank having a pair of arms, one arm being the control arm and the second arm forming the actuating button.

4. A chair, comprising:

seat portion;

back portion;

base portion; and at least one adjustable arm attachable to the chair, and capable of being moved horizontally toward and away from the chair and vertically with respect to the chair, comprising:

an arm frame assembly having a bracket at its lower end and a tubular portion extending upwardly from the bracket;

an adjustment bracket mounted in the upper end of the tubular portion of the frame assembly, said adjustment bracket having a series of vertically arranged notches within the tubular portion;

an arm body having an upper housing, and a sleeve portion slidably mounted on the tubular portion of the frame assembly;

an attachment plate fixed to the arm body upper housing having a pivot support within the upper housing;

an adjustment lever pivotally mounted on the pivot support having a control arm extending into the tubular portion of the frame assembly for engaging the notches on the adjustment bracket, permitting vertical adjustment of the arm body on the tubular portion; and an actuating button integral with the adjustment lever and extending out of the upper housing for pivoting the control arm into and out of engagement with the notches on the adjustment bracket, said adjustment lever is engaged with a spring for biasing the lever.

5. The chair of claim 4 wherein the arm frame assembly bracket has a screw and slot assembly for connecting the arm to the chair and enabling the arm to be horizontally adjusted with respect thereto.

6. The chair of claim 4 wherein the adjustment lever is a crank having a pair of arms, one arm being the control arm and the second arm forming the actuating button.

* * * * *